US009975219B2

(12) United States Patent
Fontes Da Rocha Castro et al.

(10) Patent No.: US 9,975,219 B2
(45) Date of Patent: May 22, 2018

(54) BACKING PAD WITH SLOTS FOR SANDING DISKS WITH MULTIPLE HOLES

(71) Applicant: INDASA-INDUSTRIA DE ABRASIVOS, S.A., Aveiro (PT)

(72) Inventors: Joao Miguel Fontes Da Rocha Castro, Aveiro (PT); Alfredo Manuel Farela Vizinho, Aveiro (PT); Oscar Emanuel Ratola Branco, Aveiro (PT)

(73) Assignee: INDASA-INDUSTRIA DE ABRASIVOS S.A., Aveiro (PT)

( * ) Notice: Subject to any disclaimer, the term of this patent is extended or adjusted under 35 U.S.C. 154(b) by 0 days. days.

(21) Appl. No.: 14/912,093

(22) PCT Filed: Jan. 15, 2015

(86) PCT No.: PCT/PT2015/000003
§ 371 (c)(1),
(2) Date: Feb. 15, 2016

(87) PCT Pub. No.: WO2015/119521
PCT Pub. Date: Aug. 13, 2015

(65) Prior Publication Data

US 2016/0354900 A1 Dec. 8, 2016

(30) Foreign Application Priority Data

Feb. 6, 2014 (PT) ..... 107454

(51) Int. Cl.
*B24B 23/02* (2006.01)
*B24D 9/08* (2006.01)
*B24B 55/10* (2006.01)

(52) U.S. Cl.
CPC ..... *B24D 9/08* (2013.01); *B24B 55/10* (2013.01)

(58) Field of Classification Search
CPC ..... B24B 55/10; B24D 9/08
USPC ..... 451/456, 359, 508, 344
See application file for complete search history.

(56) References Cited

U.S. PATENT DOCUMENTS 4,287,685 A * 9/1981 Marton ..... B24B 55/102 451/359
8,636,562 B2 * 1/2014 Marton ..... B24B 45/003 451/359
2009/0233527 A1 * 9/2009 Chung-Fat ..... B24B 45/003 451/28

* cited by examiner

*Primary Examiner* — Robert Rose
(74) *Attorney, Agent, or Firm* — Mark M. Friedman

(57) ABSTRACT

The present invention relates to a backing pad (1) with slots for sanding discs with multiple holes, comprising three parts, upper, intermediate and lower, joined together by a fastening system in which the upper part (2), with a frustoconical shape, includes suction holes (7) and a central hole (8), characterized in that the intermediate part (3) comprises intermediate suction slots (5), a central hole (8') and in the rear face some suction channels (6) bordered by upraised walls (10); and the lower part (4), with a frustoconical shape, and in which the intermediate part (3) will engage, comprises lower suction slots (11) and a central hole (8"), and said lower suction slots (11) are arranged in rings, concentric and equidistant between them, and the size of each of the lower suction slots (11) increases from the center to the periphery.

6 Claims, 14 Drawing Sheets

BACKING PAD WITH SLOTS FOR SANDING DISKS WITH MULTIPLE HOLES

FIELD OF THE INVENTION

The present invention relates to a backing pad with slots for sanding discs with multiple holes which allows the placement of the disc in the backing pad with a misalignment of the hole with respect to the slot of the backing pad. Wherein it guarantees that the remaining holes of the disc match with the slots that are designed for suction to match, thus facilitating the placement of the disc in the backing pad.

SUMMARY OF THE INVENTION

The backing pad with slots for sanding discs with multiple holes described in the present invention was designed to meet the following principles:

- There are concentric rings and equidistant between them in order to ensure a uniform suction over the whole area of the backing pad;
- In each concentric ring, previously mentioned, slots were built equidistant between them in order to maintain the suction area uniform;
- The width of the slots in each of the concentric rings is designed so that regardless of the misalignment that may occur in the outer holes of the disc with respect to the outer slots of the backing pad it is ensured that the inner holes of the discs still match with the respective slots. Thus reaching the widths of slots shown in the attached drawings, which allows the area of the slots to be optimized and avoiding oversizing thereof and subsequent reduction of the air speeds and flow rates in each slot/hole and always ensuring that the hole match with the slot for more effective removal of dust and particles resulting from sanding.
- The distance from each ring of the backing pad to its centre and between each of the rings is designed so that the holes existing on the traditional discs available on the market could be used with the present backing pad, maintaining all the holes matching or partially matching with the slots of the backing pads.
- The equidistance either of the rings or of the slots between each one respectively, and the width of the slots in each ring allows an easy placement of the disc on the backing pad by simply placing any hole matching with a slot, thus avoiding the search of any specific position to ensure the matching of the disc holes with the backing pad slots. The present system/concept may also be used in sanding backing pad/disc with 75 mm to 225 mm diameter, and the number of concentric rings, the number of slots, the number of holes in the disc and the distance between each one of them can be changed in order to maintain the effectiveness of the suction/removal of the dust resulting from sanding and always respecting the principle defined above concerning the equidistance of both the rings or of the slots between each of them respectively.
- The size of the slots enables the use of discs without holes, thereby giving greater stability to the disc during the sanding process of uneven surfaces.
- In order to optimize the air flows in the inner part of the backing pad various models of the backing pad have been developed and tested, essentially in the construction of channels inside them to optimize the air flows therein. Given the greater difficulty of removing dust on the inner region of the backing pad that is the region of greatest accumulation of dust, the design of the suction channels on the inner side of the backing pad allows greater efficiency in the removal of sanding dust in those regions, most precisely in the smaller concentric ring created in this backing pad. The principle was to place suction channels (inside the backing pad) that match with each concentric ring of slots, wherein each of these suction channels may be connected directly, or not, to the other suction channels. Such suction channels may be built on the inner portion of the foam or on the inner portion of the rigid region of the fastening of the backing pad to the machine.

PRIOR ART

With respect to the known multiple holes systems of the prior art, the advantages of the backing pad with slots for sanding discs with multiple holes described in the present invention are as follows:

- There are systems that do not require the alignment of the holes with respect to the backing pad, and most of the holes of the disc with multiple holes do not match with the holes in the backing pad. In these cases, it is also possible to use other set of holes of the discs, but limited to only a few varieties already existing on the market. This applies in the case if you want to keep always all the holes of disc matching with the holes of the backing pad. In the case of the present invention, with the alignment of only one hole with a slot it is ensured the alignment of all other holes with the slots (those that were set to match with the slots). With respect to the remaining set of holes of discs existing on the market, the majority and the most significant can be used with the backing pad with slots, ensuring the matching (total or partial) of the holes with the slots.
- There are multiple holes systems which require the alignment of 1 or more specific holes existing in the disc and in the backing pad, so that the remaining holes of the disc match with all the holes of the backing pad. In the case of the present invention it may be any hole of the disc at any slot of the backing pad, ensuring the matching of the remaining (which was set to match with the slots). The great advantage of the present invention is that is not necessary to rotate the disc and/or the backing pad until finding such specific holes.
- There are multiple holes systems as described in the preceding paragraphs, which in addition to the discs with multiple holes allow the use of other set of holes known on the market, however, in the case of the set of holes of discs with 15 holes, it requires the alignment of 2 or 4 specific holes of the disc, so that the remaining match with the holes of the backing pad.

The backing pad with slots for sanding discs with multiple holes described in the present invention can be aligned on the backing pad through any of the holes, ensuring the matching of all or part of the remaining slots.

BRIEF DESCRIPTION OF DRAWINGS

The description presented below is made with reference to the attached drawings which are presented only by reference, without any limitative character, and wherein.

LEGEND OF THE REFERENCE SIGNALS

Figure 1:
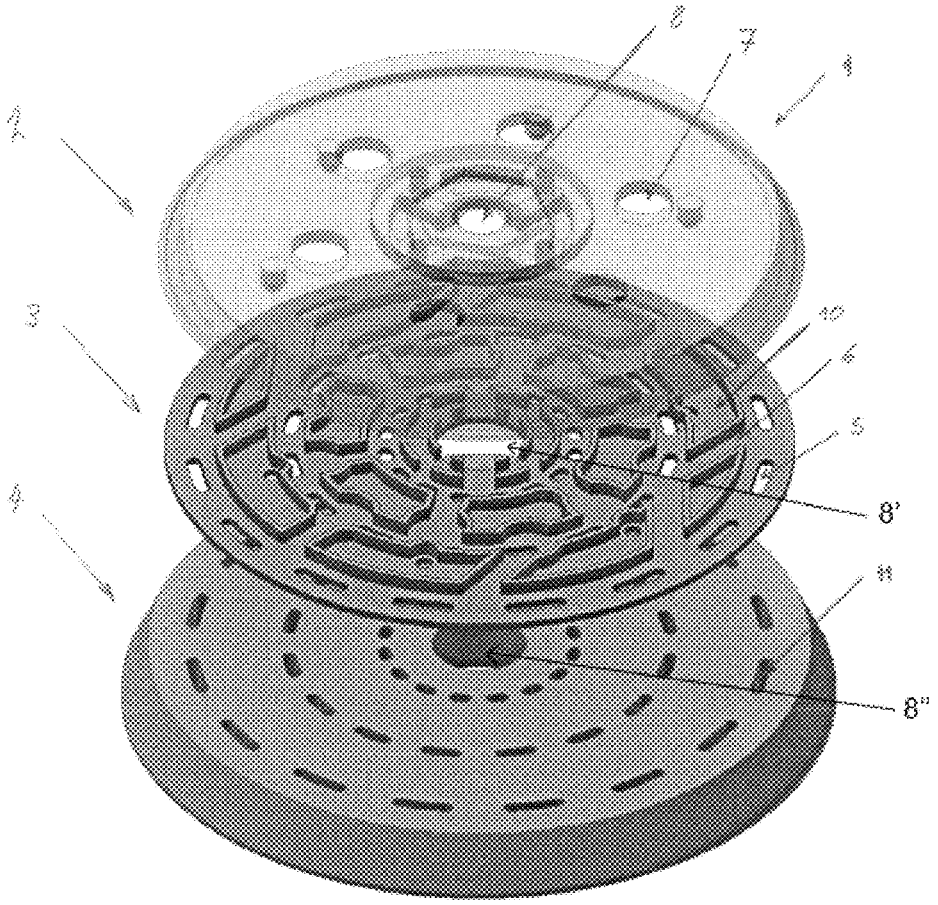
FIGS. 1-3 are isometric views of the backing pad with slots for sanding discs with multiple holes.

Backing pad (1)
Upper part (2)
Intermediate part (3)
Lower part (4)
Intermediate suction Slots (5) of the intermediate part
Channels (6)
Holes (7) of the upper part
Central hole (8)
Grooves (9)
Upraised walls (10)
Lower suction Slots (11) of the lower part
Holes (12) located on a concentric ring of the intermediate part
Equidistant holes (13) and located on a concentric ring for fastening the intermediate part to the upper part by means of respective engagement and gluing.

DETAILED DESCRIPTION OF THE INVENTION

Backing pad with slots for sanding discs with multiple holes effectively enable an improved removal of sanding material which is expressed by the absence of dust accumulation on the periphery of the discs and of the sanding backing pad when used with the backing pad described in the present invention.

The present invention relates to a backing pad with slots for sanding discs with multiple holes, which allows the placement of the disc in the backing pad with a misalignment of the hole with respect to the slot of the backing pad of 8 mm. Which ensures the matching of the remaining holes of the disc with the respective slots (that have been set for the suction to matching)—thereby facilitating the placement of the disk in the backing pad.

When using a disc on a backing pad (in the current case with a grip type of fastening system) it is well known that movements occur during the process of sanding due to the rotation of the machine and to the friction that occurs between the disc and the material that is sanded. Such movements cause misalignment in the matching of the holes. The more holes the backing pad/disc have and the smaller it is their diameter more evident is the misalignment, reaching critical cases where the hole of the disc does not match with the hole of the backing pad (during the sanding process) hindering the removal of sanding dust and accumulating excessive of said dust on the backing pad. In the case of the present invention, and if the hole is properly aligned and centred in the respective slot, FIG. 11, the above mentioned technical issue will not occur because the disc will be able to move rotationally to either side by about 4 mm (in the case of the disc with the set of holes 56H+1) and the matching of the hole with the slot will be maintained, FIG. 11, maintaining an efficient suction and preventing the excessive dust accumulation on the backing pad in the area of the holes.

Figure 12:
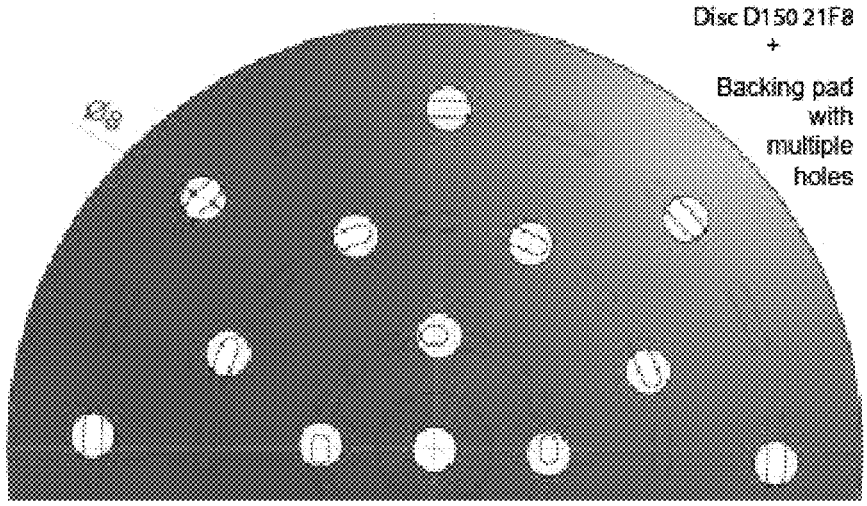
FIG. 12 is a top view of a sanding disc with multiple holes, with 21F+1 holes.

In the case of a disc with a set of holes 20H+1 the disc will be able to move rotationally to either side by about 2.5 mm, FIG. 12, and the matching of the hole of the disc with respect to the slot will be maintained, however, if this movement is higher, as the size of the hole is 8 mm the total misalignment will never occur. That is, even when this movement is higher at least a partial matching will be kept which will always ensure the removal of dust, FIG. 12.

Figure 11:
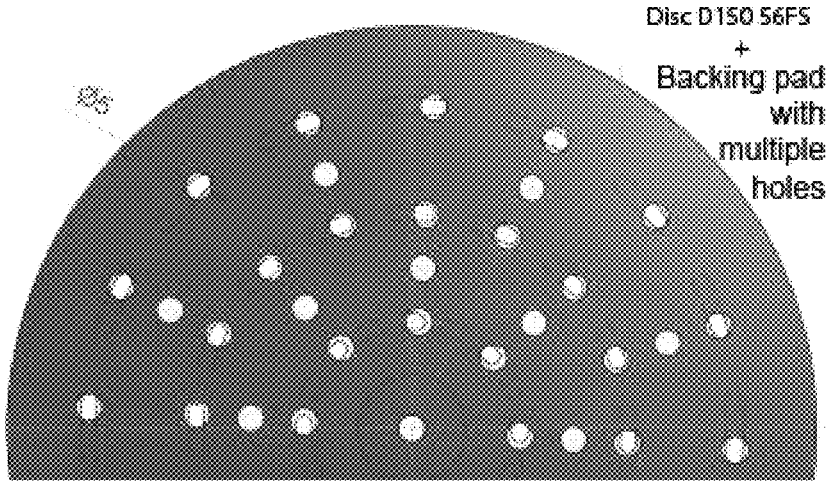
FIG. 11 is a top view of a sanding disc with multiple holes, with 56H+1 holes.

To place the disc with multiple holes in the backing pad with slots you just have to align any of the holes of the disc with any of the slots of the backing pad, wherein the remaining holes of the disc will always match with all the slots of the backing pad (which were set for the suction to matching) for the disc with the set of holes 56H+1, FIG. 11. In the case of the set of holes 20H+1 all the holes of the disc will match with the slots of the backing pad, FIG. 12.

In order for the whole area of the disc to have an uniform suction and without prejudice to the reduction of air speed in each slot, it was decided not to increase the amount of slots, however, holes of the disc were set for not to match with slots, but due to air flows which are caused by closer slots effective suction is ensured by these holes. In the case of discs with the set of holes 20H+1, all the holes of the disc always match with the slots of the backing pad, regardless of the position of the disc with respect to the backing pad, FIG. 12.

Figure 14:
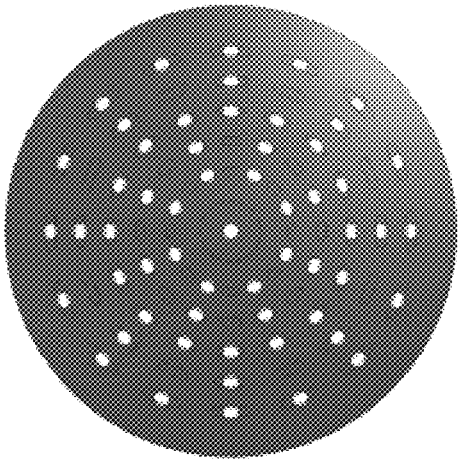
FIG. 14 is a top view of a sanding disc with multiple holes, with 56+1 holes.
Figure 15:
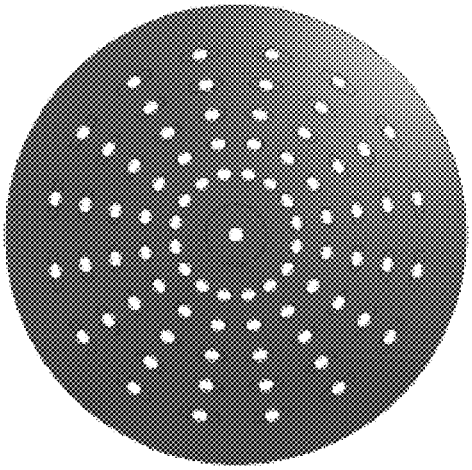
FIG. 15 is a top view of a sanding disc with multiple holes, with 80+1 holes.

The suction occurring in holes that do not match, FIG. 11, above described, may not be enough in the case the particles resulting from the sanding are bigger than a certain size, in this case, the backing pad may be designed with 80 slots which match with all the holes of the discs 56H+1 or 80H+1, according to FIGS. 14-15. In the case of disc 20H+1, this technical issue will not occur because, regardless of the disc placement, all the holes match always with the slots, FIG. 12.

Given the geometry of the backing pad and the size of the slot with a low flow rate of the suction system it is guaranteed a specific air speed in each slot that allows a good suction effectiveness and the consequent dust removal. In traditional systems, the size of the holes does not guarantee, with a low flow rate of the suction system, an air speed that enables a good suction effectiveness and the consequent dust removal.

Figure 17:
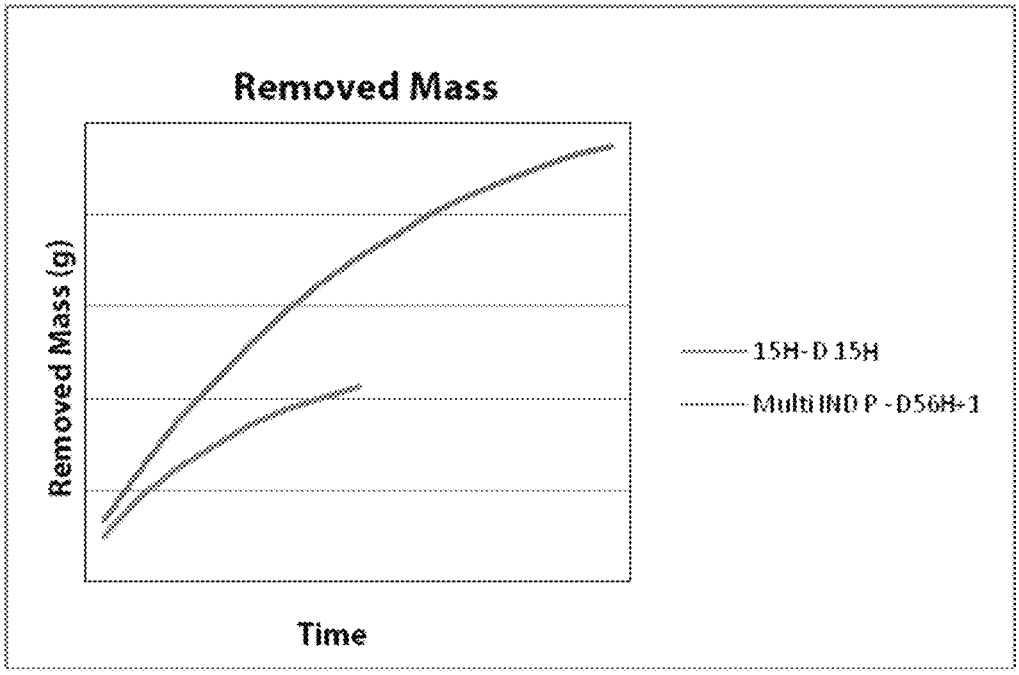
FIG. 17—Graph 1—Comparative Yield Test—With low suction flow rate, where the upper curve correspond to the present invention.
Figure 18:
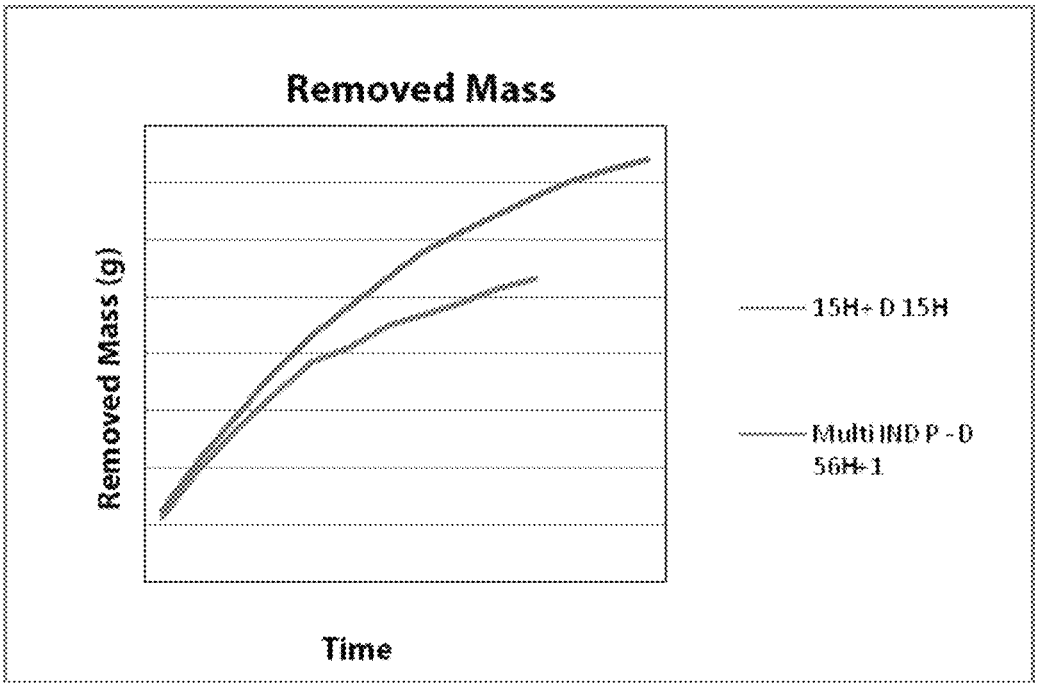
FIG. 18—Graph 2—Comparative Yield Test—With normal suction flow rate, where the upper curve correspond to the present invention.

The analysis of FIGS. 17 and 18, shows that in the case of a normal suction flow rate the yield difference between the 15H system and the system of the present invention is smaller.

In the case of a low suction flow rate the yield difference between the 15H system and the system of the present invention is considerably higher.

By normal flow rate is meant: the flow rate powered by a vacuum cleaner for sanding systems that are clean–Filters+ New dust collection bag.

By low flow rate is meant: the flow rate powered by a vacuum cleaner for sanding systems with clogged filters and dust collection bag.

Backing Pad Slot+Disc 15H, 8H+1, 8H, 6H+1 and 6H

Any backing pad of 15H or more holes existing on the market requires for the alignment of the set of holes of the discs 15H with the backing pad of 15 holes to rotate the disc (or backing pad) so that the 2 (or four holes) aligned along the disc diameter may coincide with the respective holes of the backing pad (with holes of the same geometry). In the case of the placement in the backing pad with slots of a disc with 15 holes we only have to align any of the holes of the disc 15H with any of the slots and all the others will match (total or partial) with the slots of the backing pad, FIG. 16.

In the case of utilization of backing pads 15H with discs without holes, in the area of the holes of the backing pad the discs without holes are subject to a large area without sustainability. In the case of the backing pad with slot, given the small size of the slots (width 3 mm), it allows the placement of discs without holes minimizing the most the disc area that is unsustainable on the backing pad.

That is, the traditional backing pads with multiple holes with 15 holes (included) or those of 15 holes or 8 holes 8 or those of 6 holes, when one disc without holes is placed for sanding operations of uneven surfaces (e.g. contoured, protrusions, etc.) the disc can de damaged in the region of the holes of the backing pad, as the diameter of the holes is 8-10 mm. In the case of the backing pad of the present invention given the size of each slot and essentially in the innermost concentric rings where the area of each slot is smaller the risk of damaging the sanding disc without holes is substantially avoided (it should be noted that the most central portion of the disc is usually the most requested in the above mentioned sanding operations).

Figure 16:
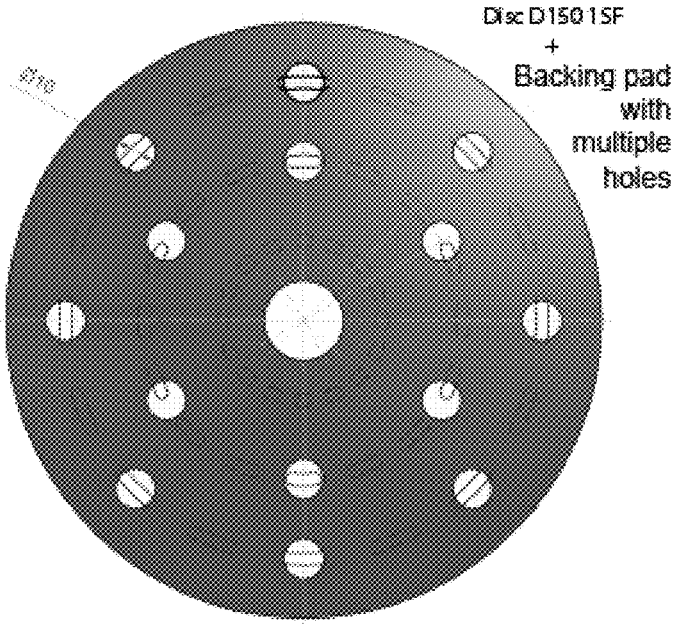
FIG. 16 is a top view of a sanding disc with 15 holes.

In the case of discs with the set of holes 8H+1, 8H, 6H+1 and 6H the geometry of the slots on the backing pad allows, also requiring the alignment of only any hole of the disc with any of the slots, the instantaneous alignment of the remaining holes of the disc with the slots of the backing pad, FIG. 16.

Figure 19:
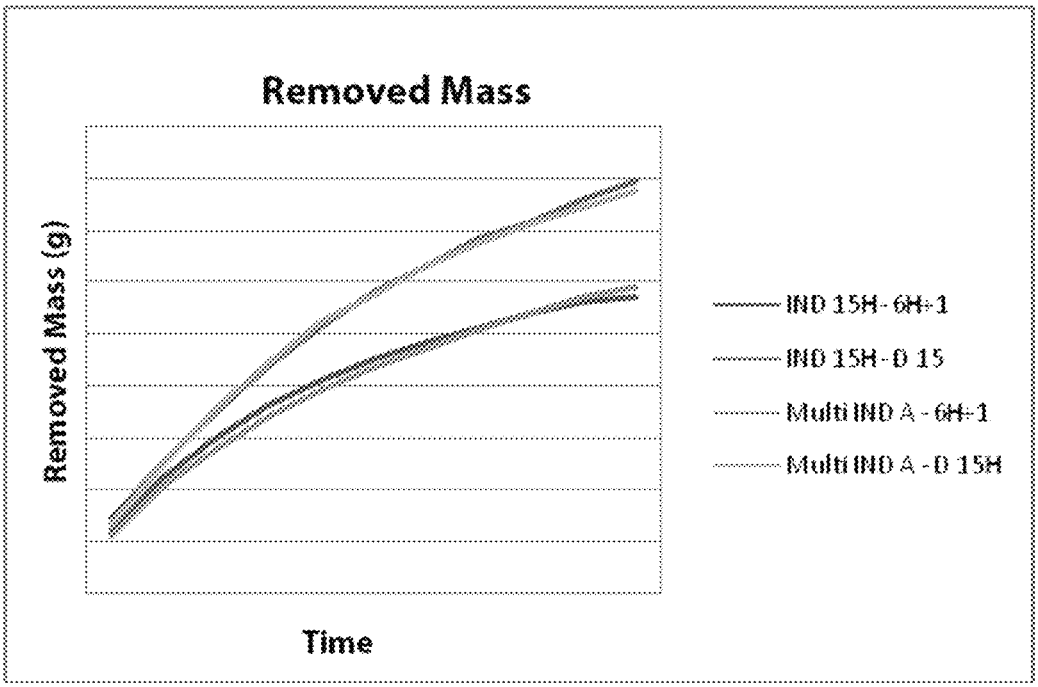
FIG. 19—Graph 3—Comparative Yield Test—Backing pad 15H and Backing pad Multi-Indasa with disc with set of holes 15H and 6H+1, where the upper set of curves corresponds to the tests IND 15H-D 15 and Multi IND A-D15H and the lower set of curves corresponds to the tests IND 15H-6H+1 and Multi IND A-6H+1. Additionally, in both sets of curves, the brighter ones correspond to the present invention. Additionaly IND 15H-6H+1: Test performed with backing pad of 15 holes and disc with 6 holes plus 1; IND 15H-D15H: Test performed with backing pad of 15 holes and disc with 15 holes; Multi IND A-6H+1: Test performed with backing pad Multi-Indasa and disc with 6 holes plus 1; Multi IND A-D15H: Test performed with backing pad Multi-Indasa and disc with 15 holes.

By ensuring the matching of one slot (or part of the slot) with any of the holes of the disc (all of the above mentioned set of holes) good suction is guaranteed according to the respective backing pads for the respective set of holes (Backing pad 6H+1 with discs 6H+1 and 6H, Backing pad 8H+1 with discs 8H+1 and 8H, Backing pad 15H with discs 15H). Thus the yield of the discs according to the combination of Backing pad 15 Holes and the backing pad of the present invention with the various set of holes already mentioned, remain very close as it is shown in FIG. 19.

Figure 13:
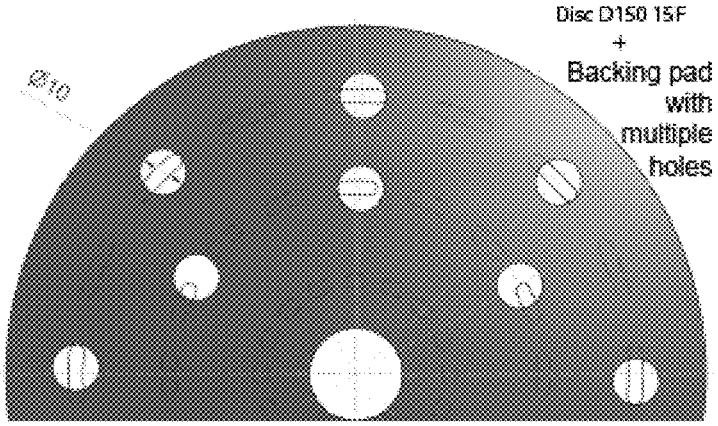
FIG. 13 is a top view of a sanding disc with 15 holes and the corresponding misalignment with the backing pad with multiple holes.

The backing pad described in the present invention allows during the placement of the disc in the backing pad with slots a misalignment of the hole with respect to the slot of the backing pad of about 3 mm, FIG. 13. Wherein it ensures the matching (partial or total) of the remaining holes of the disc with the slots—thus making it easier to place the disc.

Figure 2:
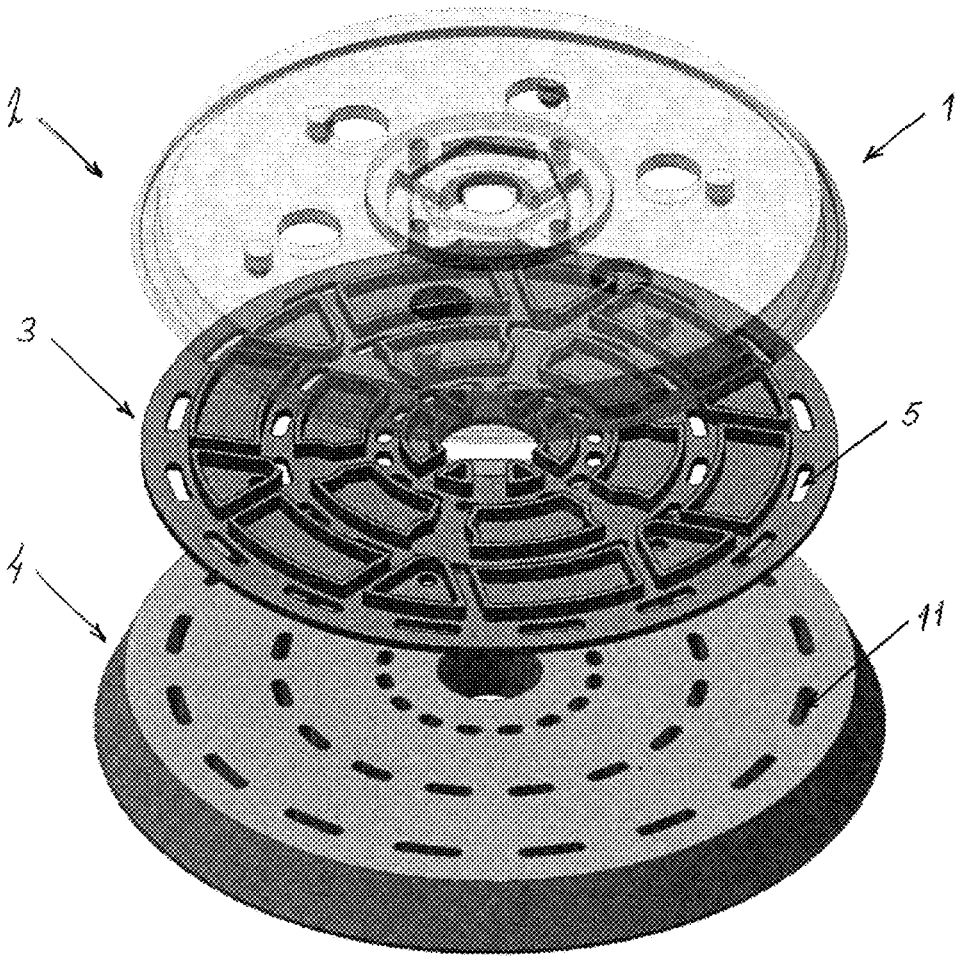
Figure 3:
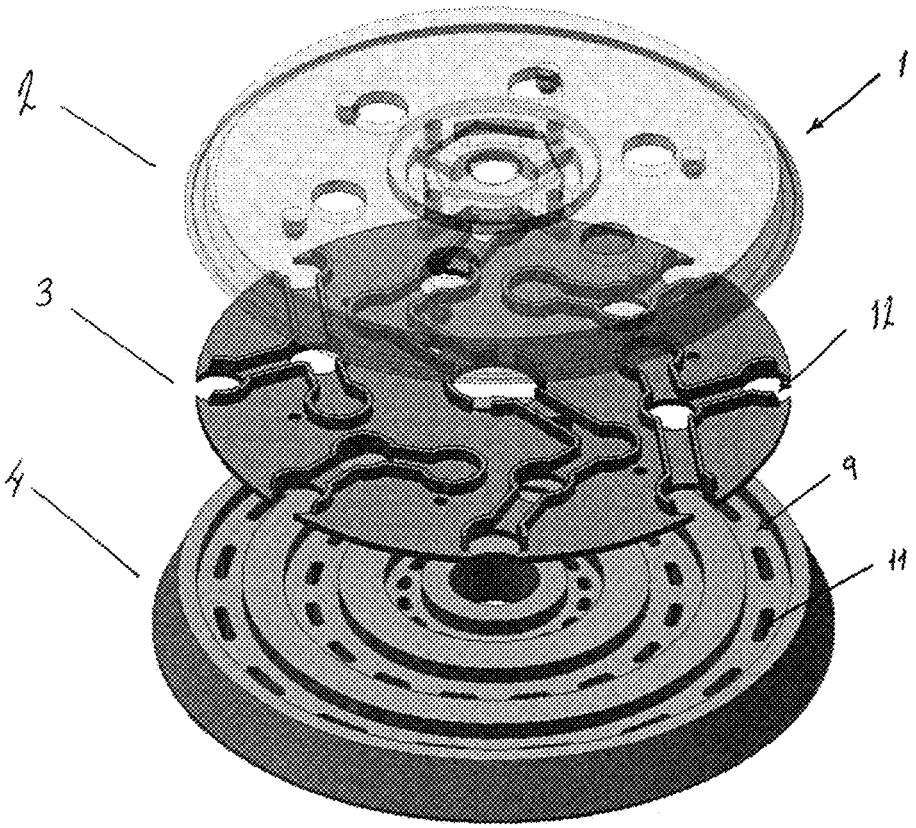
Figure 4:
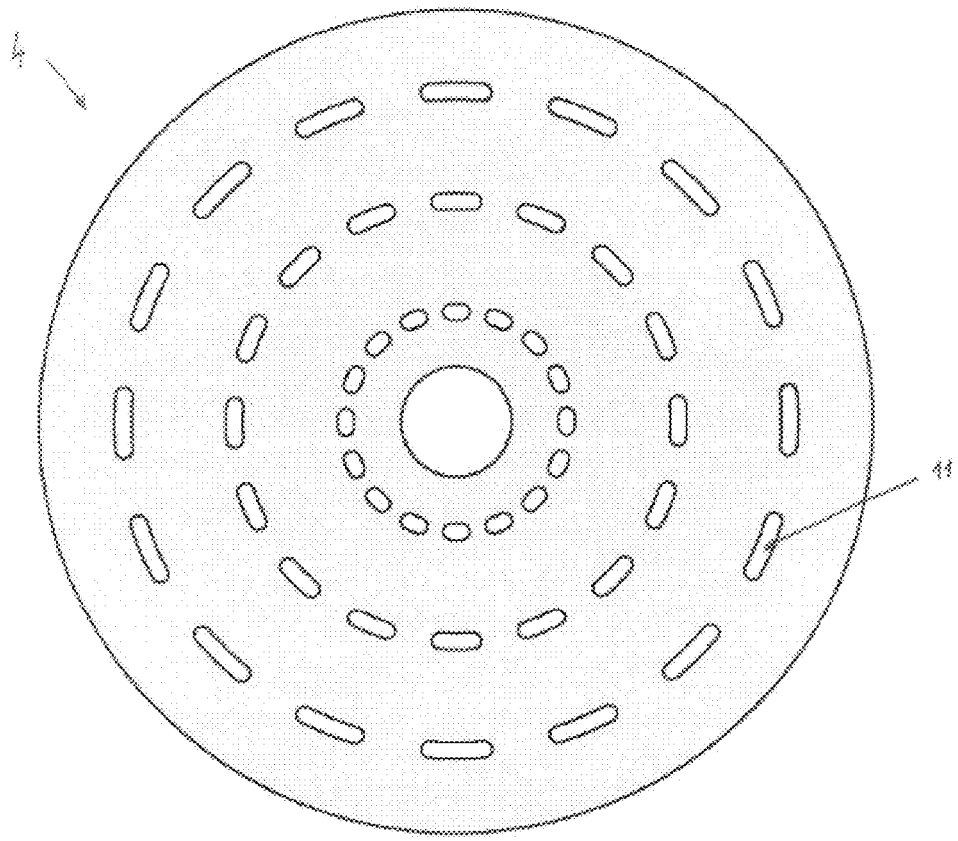
FIG. 4 is a view of the front face of the lower part of the backing pad with slots for sanding discs with multiple holes.

As can be seen in FIGS. 1-3 the backing pad (1) with slots for sanding discs with multiple holes, comprising three parts joined together by a fastening system:

- the upper part (2), with a frustoconical shape, includes suction holes (7) and a central hole (8);
- the intermediate part (3) comprises intermediate suction slots (5), a central hole (8') and in the rear face some suction channels (6) bordered by upraised walls (10);
- the lower part (4), with a frustoconical shape, and in which the intermediate part (3) will engage, comprises lower suction slots (11) and a central hole (8"), and said suction slots (11) are arranged in rings, concentric and equidistant between them, and the size of each of the lower suction slots (11) increases from the centre to the periphery.

Figure 6:
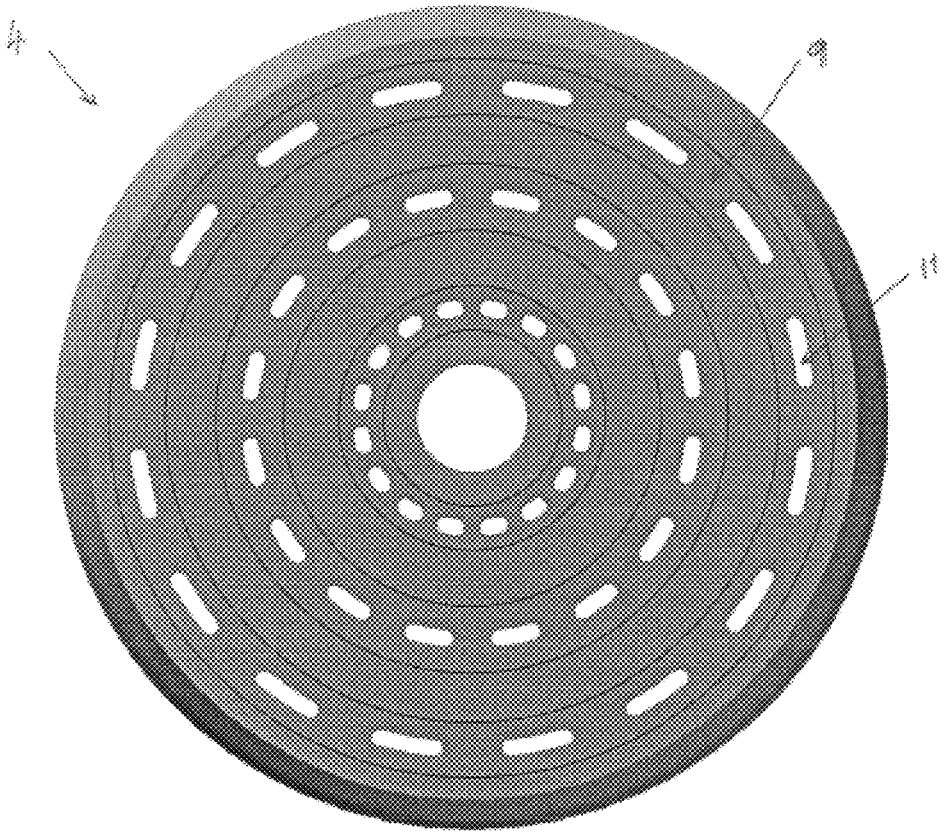
FIG. 6 is a view of the rear face of the lower part of the backing pad with slots for sanding discs with multiple holes.

In FIG. 6 it can be seen that the rear face of the lower part (4) comprises suction grooves (9), located at concentric and equidistant rings between them, said grooves (9) include the lower suction slots (11).

The intermediate suction slots (5) of the intermediate part (3) match with the lower suction slots (11) of the lower part (4).

In the backing pad with slots for sanding discs with multiple holes the intermediate part (3) comprises various holes (13) equidistant and located according to a concentric ring for fastening the intermediate part to the upper part by means of respective engagement and gluing.

The shape of the upraised walls (10) delimiting the channels (6) defines the shape of the channels (6).

Embodiments of the Invention

Figure 5:
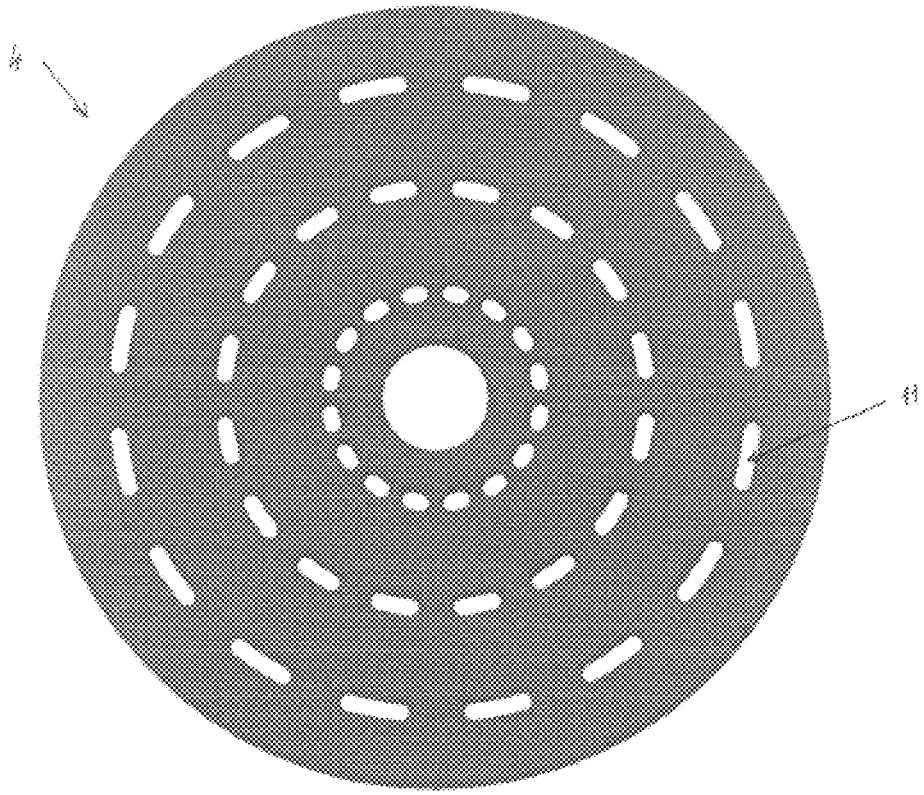
FIG. 5 is a view of the rear face of the lower part of the backing pad with slots for sanding discs with multiple holes.

The lower part (4) can have two embodiments, as can be seen in FIGS. 5-6 respectively.

The lower suction slots (11), represented in FIGS. 5-6, are arranged in rings, concentric and equidistant between them, and the size of each of the lower suction slots (11) increases from the centre to the periphery.

Figure 7:
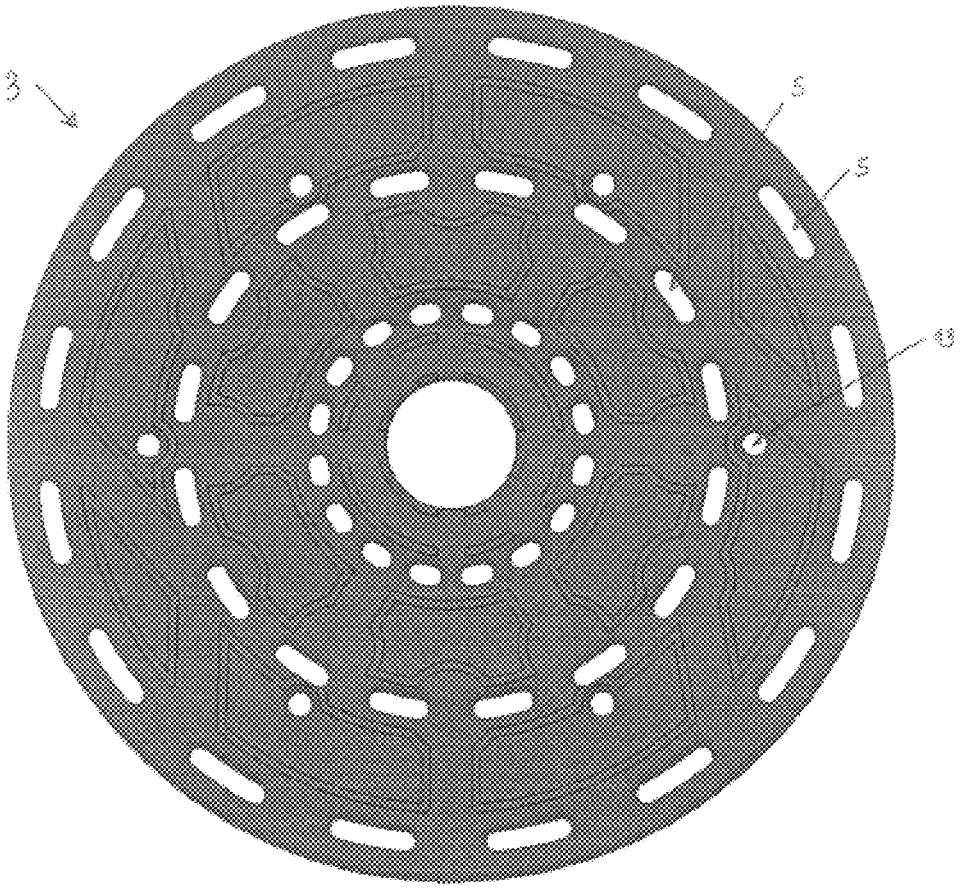
FIGS. 7-9 are views of the rear face of the intermediate part of the backing pad with slots for sanding discs with multiple holes.
Figure 8:
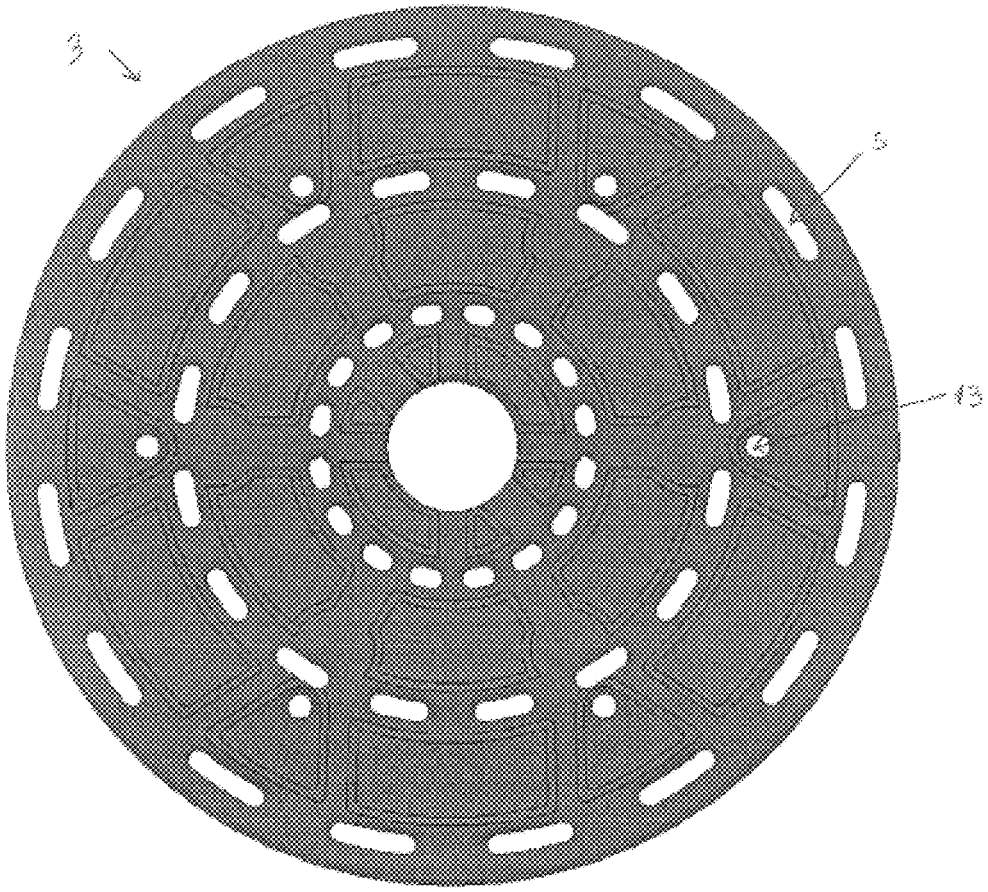
Figure 9:
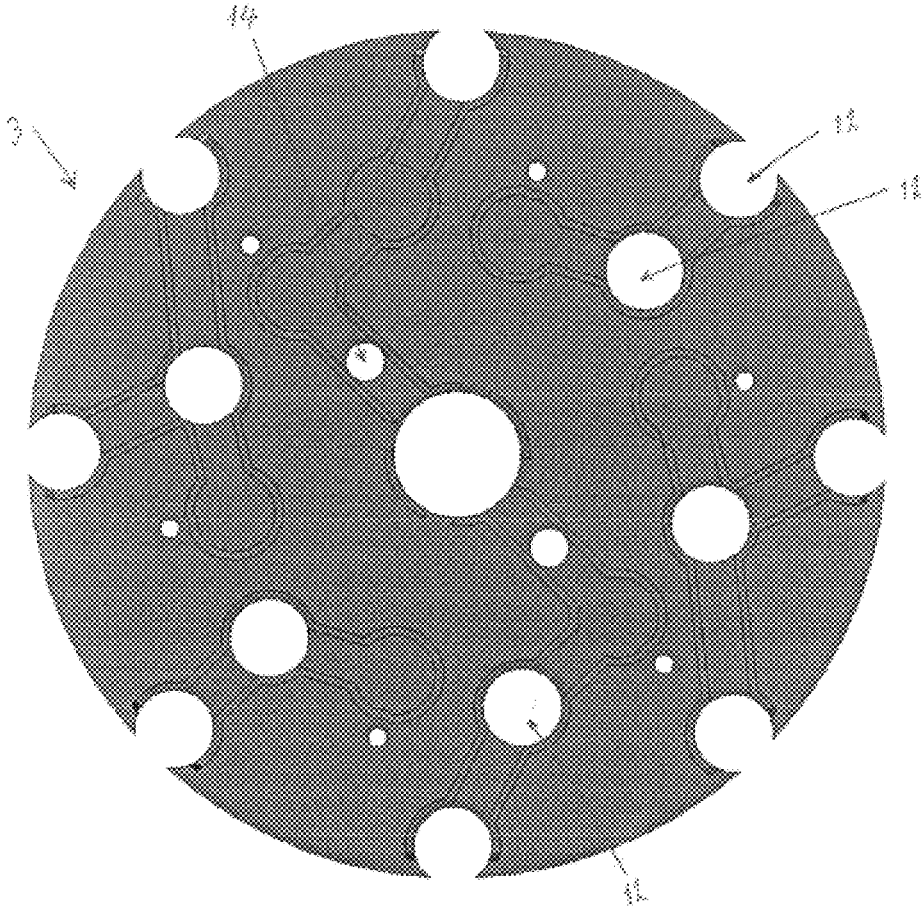
Figure 10:
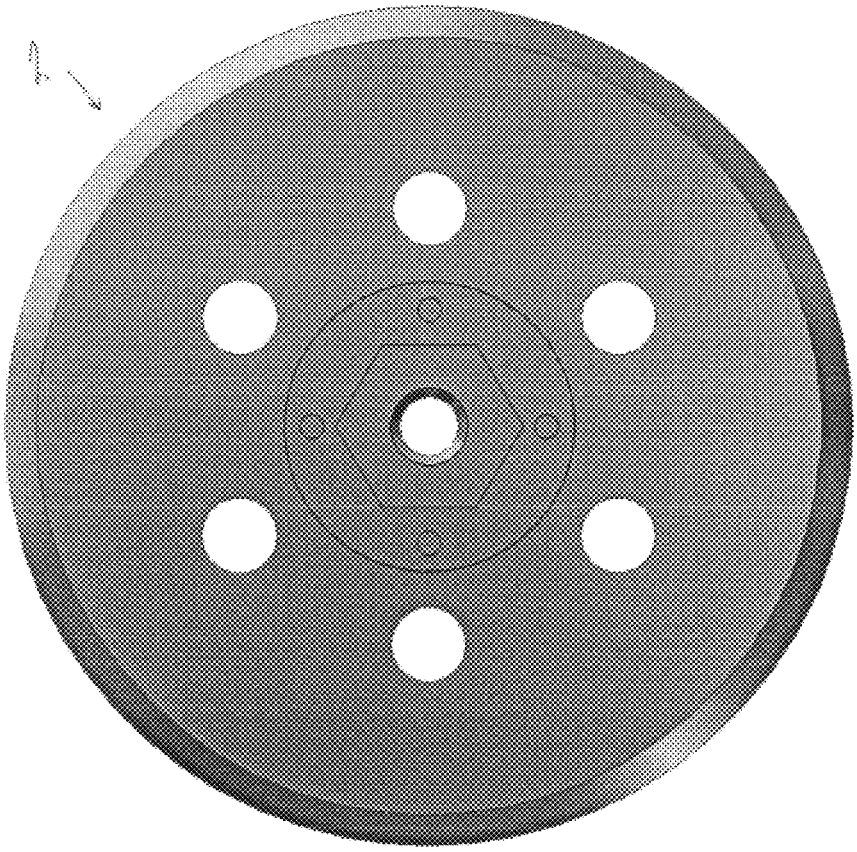
FIG. 10 is a view of the rear face of the upper part of the backing pad with slots for sanding discs with multiple holes.

On the other hand, the intermediate part (3) can have three embodiments, as can be seen in FIGS. 7-9 respectively.

Thus, in one of the embodiments, as can be seen in FIG. 9 the intermediate part (3) comprises:

- equidistant holes (12) on the periphery;
- inside the upraised walls (10), bordering the suction channels (6), holes (12) that are located on a concentric ring; and
- Inside the upraised walls (10) bordering the suction channels (6), some holes (12).

As will be apparent to one skilled in the art, it is possible various minor alterations, which, however, should be included within the scope of the invention.

The invention should be limited only by the spirit of the following claims.

The invention claimed is:

1. Backing pad (1) with slots for sanding discs with multiple holes, comprising three parts, upper, intermediate and lower, joined together by a fastening system in which the upper part (2), with a frustoconical shape, includes suction holes (7) and a central hole (8), characterized in that the intermediate part (3) comprises suction slots (5), a central hole (8') and in the rear face some suction channels (6) bordered by upraised walls (10);

the lower part (4), with a frustoconical shape, and in which the intermediate part (3) will engage, comprises lower suction slots (11) and a central hole (8"), and said lower suction slots (11) are arranged in rings, concentric and equidistant between them, and the size of each of the lower suction slots (11) increases from the centre to the periphery.

2. Backing pad with slots for sanding discs with multiple holes according to the preceding claim, characterized in that the rear face of the lower part (4) comprises suction grooves (9), located at concentric and equidistant rings between them, said grooves (9) include the lower suction slots (11).

3. Backing pad with slots for sanding discs with multiple holes according to claim 1, characterized in that the intermediate suction slots (5) of the intermediate part (3) match with the lower suction slots (11) of the lower part (4).

4. Backing pad with slots for sanding discs with multiple holes according to claim 1, characterized in that the intermediate part (3) comprises:

equidistant holes (12) on the periphery;

inside the upraised walls (10), bordering the suction channels (6), holes (12) that are located on a concentric ring; and inside the upraised walls (10) bordering the suction channels (6), some holes (12).

5. Backing pad with slots for sanding discs with multiple holes according to claim 1, characterized in that the intermediate part (3) further comprises equidistant fastening holes (13) located on a concentric ring.

6. Backing pad with slots for sanding discs with multiples holes according to claim 1, characterized in that the shape of the upraised walls (10) bordering the channels (6) defines the shape of the channels (6).

* * * * *